US012606995B2

(12) United States Patent
Huang et al.

(10) Patent No.: US 12,606,995 B2
(45) Date of Patent: Apr. 21, 2026

(54) MAGNET BUSHING STRUCTURE FOR PULL-OUT FAUCET AND PULL-OUT FAUCET

(71) Applicant: Xiamen Lota International Co., Ltd., Xiamen (CN)

(72) Inventors: Qiang Huang, Xiamen (CN); Chunsen Lin, Xiamen (CN); Qian Chen, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 243 days.

(21) Appl. No.: 18/541,592

(22) Filed: Dec. 15, 2023

(65) Prior Publication Data

US 2025/0075473 A1 Mar. 6, 2025

(30) Foreign Application Priority Data

Aug. 28, 2023 (CN) ..... 202311087049.0

(51) Int. Cl.
*E03C 1/04* (2006.01)

(52) U.S. Cl.
CPC .... *E03C 1/0404* (2013.01); *E03C 2001/0415* (2013.01); *E03C 2001/0416* (2013.01)

(58) Field of Classification Search
CPC ..... E03C 1/0404; E03C 2001/0415; E03C 2001/0416; E03C 1/04; F16K 27/00
USPC ..... 4/678, 675, 567
See application file for complete search history.

(56) References Cited

U.S. PATENT DOCUMENTS

| | | | | |
|---|---|---|---|---|
| 11,781,300 | B2 * | 10/2023 | Yan | E03C 1/0401 4/623 |
| 12,065,811 | B2 * | 8/2024 | Ghiglieri | E03C 1/0402 |
| 2020/0063407 | A1 * | 2/2020 | Zhu | E03C 1/0404 |
| 2022/0136224 | A1 * | 5/2022 | Yan | E03C 1/057 4/623 |
| 2023/0087948 | A1 * | 3/2023 | Heuer | F16L 27/0849 137/615 |

FOREIGN PATENT DOCUMENTS

| | | | | |
|---|---|---|---|---|
| CN | 107642629 A | * | 1/2018 | F16K 27/00 |
| CN | 207500573 U | * | 6/2018 | F16K 27/00 |
| CN | 108397588 A | * | 8/2018 | F16K 27/00 |

* cited by examiner

*Primary Examiner* — Lori L Baker
(74) *Attorney, Agent, or Firm* — Cooper Legal Group, LLC

(57) ABSTRACT

A magnet bushing structure for a pull-out faucet comprises a sheath and a bushing. The sheath is configured for being fixedly connected to a water outlet bent tube of the pull-out faucet, and the sheath comprises an installation channel. The bushing is at least disposed with a magnetic member to enable the bushing to magnetically absorb a pull-out head of the pull-out faucet, and the bushing is detachably installed on the installation channel through a buckle structure.

17 Claims, 13 Drawing Sheets

MAGNET BUSHING STRUCTURE FOR PULL-OUT FAUCET AND PULL-OUT FAUCET

RELATED APPLICATIONS

This application claims priority to Chinese patent application number 202311087049.0, filed on Aug. 28, 2023. Chinese patent application number 202311087049.0 is incorporated herein by reference.

FIELD OF THE DISCLOSURE

The present disclosure relates to a magnet bushing structure for a pull-out faucet and the pull-out faucet.

BACKGROUND OF THE DISCLOSURE

The conventional pull-out faucets currently on the market include a faucet body, a faucet bent tube, and a pull-out water outlet head. A magnetic bushing is provided at a distal end of the faucet bent tube. The pull-out water outlet head is pullably arranged at the distal end of the faucet bent tube. The magnetic bushing serves to magnetically position the pull-out water outlet head. The connection method between the magnetic bushing and the faucet bent tube is generally one of the following two methods.

In the first connection method, the magnetic bushing is provided with a claw, and the magnetic bushing is directly buckled to a machined groove on an inner wall of the faucet bent tube through the claw. Disassembly is indeed possible in the first connection method, but the faucet bent tube requires a very thick wall to form the machined groove. The entire faucet bent tube is very heavy and very costly. In this method, the claw is made of plastic, and an elastic force of the plastic is used to restore the claw to a certain deformation after passing through an interference section of the faucet bent tube. After the claw passes through an interference section and is restored to an original shape to be buckled to the machined groove, the magnetic bushing can bear a pull down force and the magnetic bushing can withstand the required pulling force. The magnet bushing is removable. However, the machined groove is placed on the faucet bent tube, which results in a wall thickness of the machined groove being too thick and the cost of machining the machined groove for the faucet bent tube being high.

In the second connection method, the magnet bushing is buckled to the machined groove of the faucet bent tube. However, the magnet bushing needs to be fixed with glue. This structure cannot be disassembled or assembled. However, the faucet bent tube does not need to have a thick wall, and the cost is low. This magnet bushing snaps onto the machined groove of the faucet bent tube using the glue. In order to withstand the required pulling force, the structure cannot be dismantled.

BRIEF SUMMARY OF THE DISCLOSURE

The present disclosure provides a magnet bushing structure to solve the deficiencies in the background, which can reduce a thickness of a wall of a water outlet bent tube and meet disassembly and assembly needs.

In order to solve the technical problem, a first technical solution of the present disclosure is as follows.

A magnet bushing structure for a pull-out faucet comprises a sheath and a bushing. The sheath is configured for being fixedly connected to a water outlet bent tube of the pull-out faucet, and the sheath comprises an installation channel. The bushing is at least disposed with a magnetic member to enable the bushing to magnetically absorb a pull-out head of the pull-out faucet, and the bushing is detachably installed on the installation channel through a buckle structure.

In a preferred embodiment, an outer wall of the sheath is at least glued to the water outlet bent tube of the pull-out faucet, and the sheath further comprises one or more buckle positioning members which are positioned at and connected to one or more positioning holes of the water outlet bent tube.

In a preferred embodiment, the bushing comprises a first claw and a plurality of second claws. A first end of the first claw is connected to an upper end surface of the bushing, and a second end of the first claw comprises a hooking portion. The plurality of second claws are disposed on an outer wall of the bushing, and an upper end surface of the sheath comprises a hooking groove. An inner wall of the installation channel comprises a plurality of buckle holes configured to correspond to the plurality of second claws, and the first claw is configured to pass through the installation channel so that the hooking portion is hooked on the hooking groove. The bushing is configured to be rotated about the hooking groove until the plurality of second claws are buckled to the plurality of buckle holes.

In a preferred embodiment, the installation channel comprises an interference section, and a diameter of the interference section is larger than an outer diameter of the outer wall of the bushing. The plurality of second claws are elastic claws, and the plurality of second claws are configured to elastically deform when the plurality of second claws pass through the interference section. The interference section is configured for being sleeved on the outer wall of the bushing.

In a preferred embodiment, a lower end of the installation channel comprises a first annular guiding surface, and a lower end of the outer wall of the bushing comprises a second annular guiding surface that is configured to be matched with the first annular guiding surface.

In a preferred embodiment, the outer wall of the bushing comprises a plurality of anti-rotation ribs extending along an axial direction of the bushing, and the installation channel comprises a plurality of anti-rotation grooves in which the plurality of anti-rotation ribs are disposed.

In a preferred embodiment, an upper end of the bushing comprises a plurality of third claws and at least one anti-rotation mechanism, and an upper side of the installation channel comprises a plurality of rotation buckle positions. The upper side of the installation channel comprises at least one anti-rotation recess, and the bushing is configured to be axially installed from a lower end of the installation channel to a first installation position. The bushing is configured to be operatively rotated from the first installation position to a second installation position. When at the second installation position, the plurality of third claws are connected to the plurality of rotation buckle positions to inhibit axial movement of the bushing, and the at least one anti-rotation mechanism is connected to the at least one anti-rotation recess to inhibit circumferential movement of the bushing.

In a preferred embodiment, each of the plurality of rotation buckle positions comprises a first through groove arranged on the installation channel along an axial direction of the installation channel, and each of the plurality of rotation buckle positions comprises a buckle surface. The buckle surface extends along a circumferential direction of the installation channel, and the plurality of third claws are configured to move in the first through groove in the axial direction of the installation channel to correspond to the buckle surface at the first installation position. The plurality of third claws are configured to be rotated in the circumferential direction of the installation channel to be at the second installation position to be correspondingly buckled to the buckle surface, and the at least one anti-rotation mechanism comprises an elastic cantilever. The elastic cantilever and the at least one anti-rotation recess defines a ratchet-and-pawl type of anti-rotation mechanism.

In a preferred embodiment, an outer wall of the bushing comprises a plurality of anti-loosening ribs, and the plurality of anti-loosening ribs are in contact with an inner wall of the installation channel. A lower end of the bushing comprises one or more wrench grooves, and the one or more wrench grooves are configured to be connected to tools so that the tools are configured to drive the bushing to rotate.

A second technical solution of the present disclosure is as follows.

The pull-out faucet, comprising the magnet bushing structure.

Compared with the existing techniques, the technical solution has the following advantages.

The magnetic bushing structure is detachably divided into the sheath and the bushing. The sheath is fixedly connected to the water outlet bent tube. The bushing is detachably installed on the installation channel of the sheath through the buckle structure. The sheath actually increases a wall thickness of the water outlet bent tube without increasing an overall wall thickness of the water outlet bent tube. The bushing can be disassembled and detached from the sheath, which is convenient for user operation.

DETAILED DESCRIPTION OF THE EMBODIMENTS

The present disclosure will be further described below in combination with the accompanying drawings and embodiments.

Figure 1:
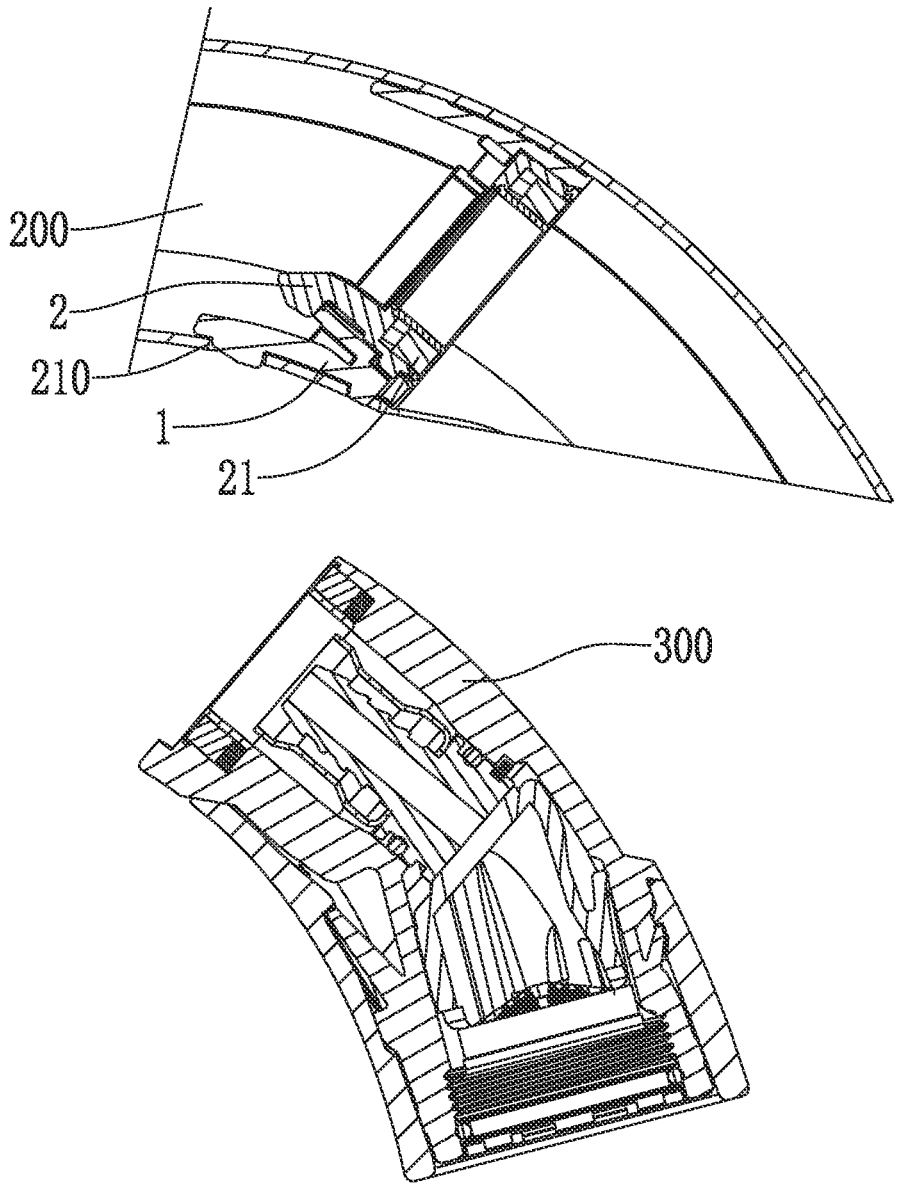
FIG. 1 illustrates a cross-sectional view of a magnetic bushing structure, a water outlet bent tube, and a pull-out head in a first embodiment of the present disclosure.
Figure 2:
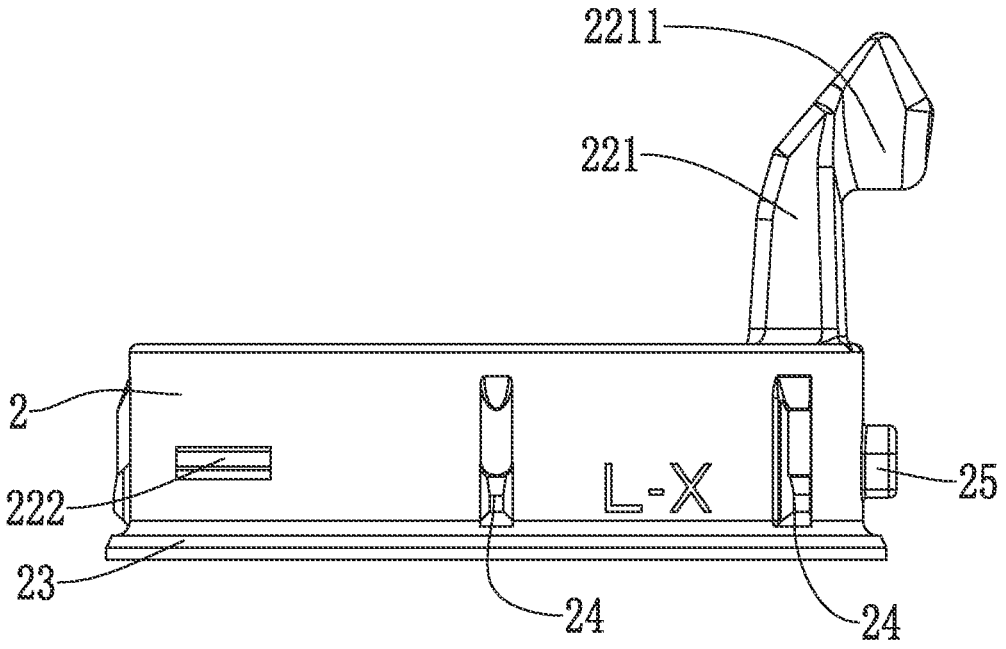
FIG. 2 illustrates a side view of a bushing in the first embodiment of the present disclosure.
Figure 3:
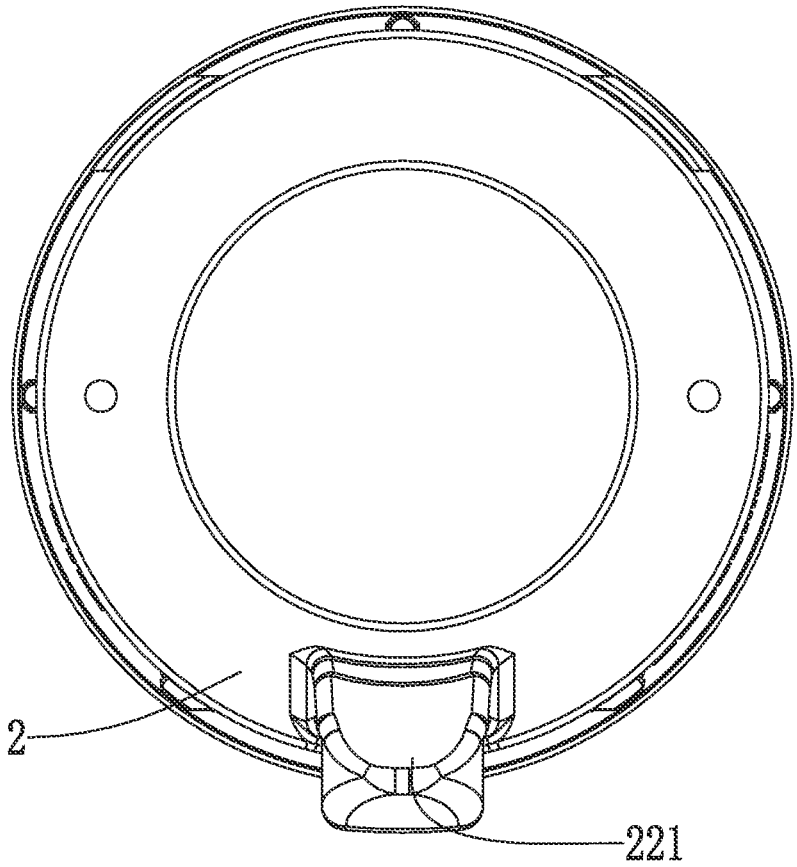
FIG. 3 illustrates a top view of the bushing in the first embodiment of the present disclosure.
Figure 4:
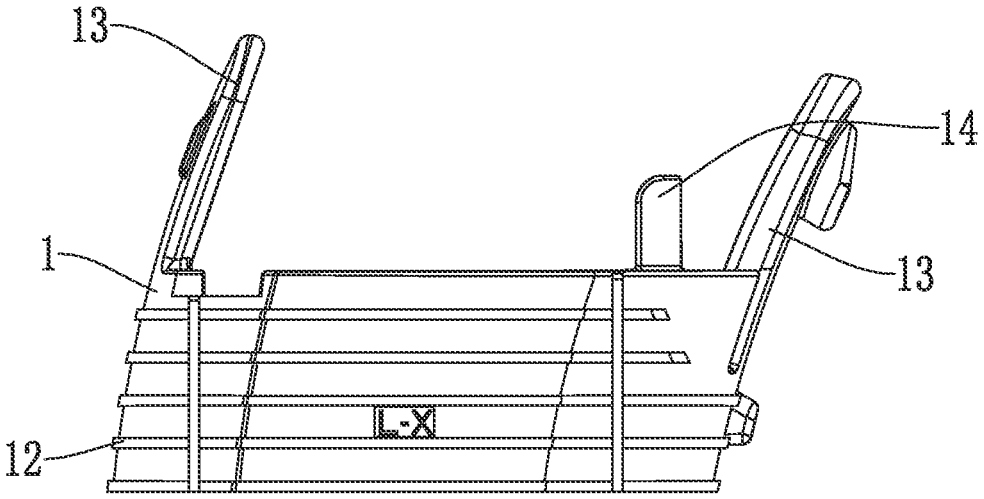
FIG. 4 illustrates a side view of a sheath in the first embodiment of the present disclosure.
Figure 5:
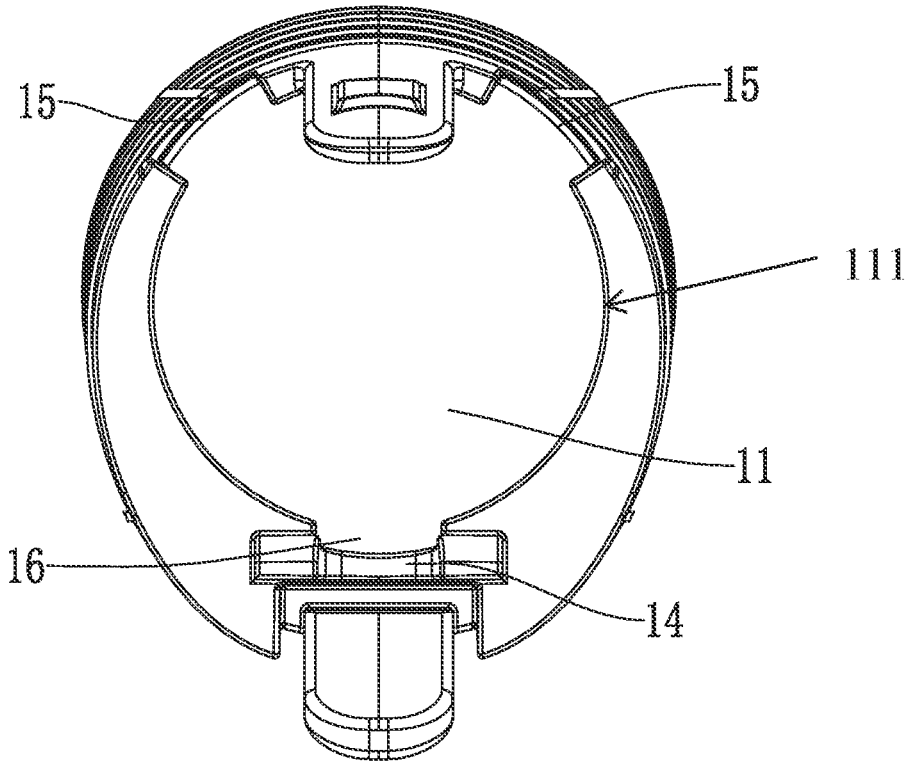
FIG. 5 illustrates a top view of the sheath in the first embodiment of the present disclosure.
Figure 6:
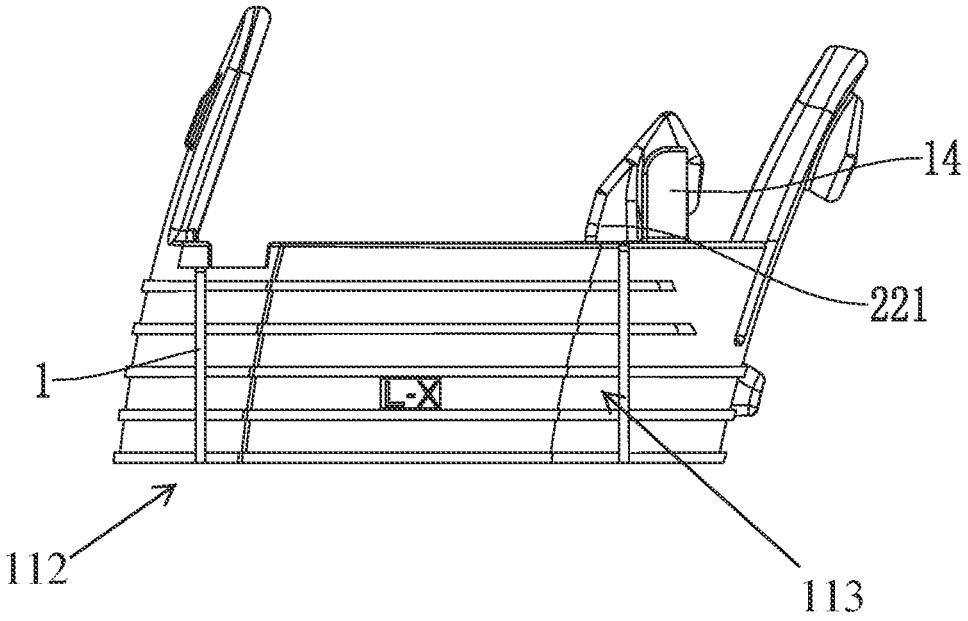
FIG. 6 illustrates a side view of the sheath in the first embodiment of the present disclosure.
Figure 7:
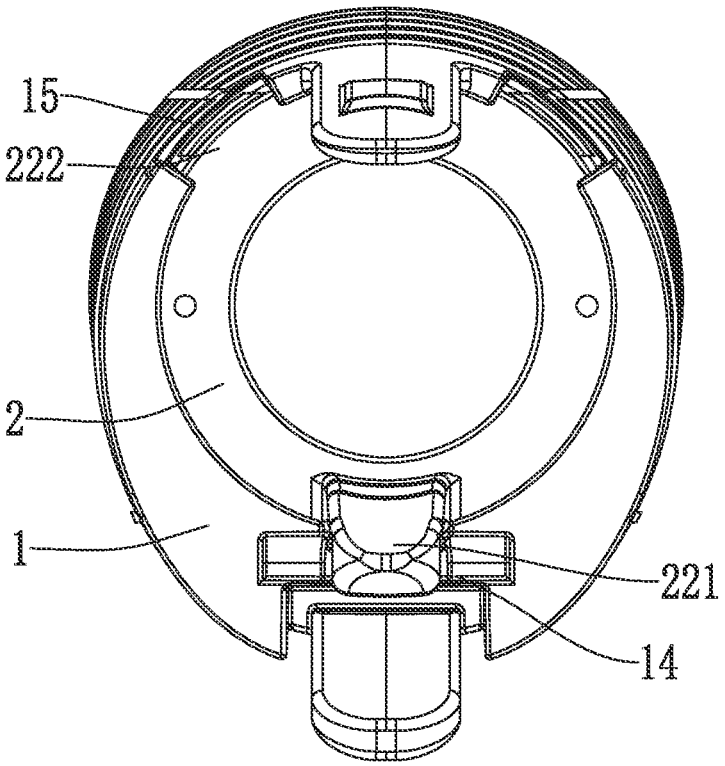
FIG. 7 illustrates a top view of the sheath and bushing when connected in the first embodiment of the present disclosure.
Figure 8:
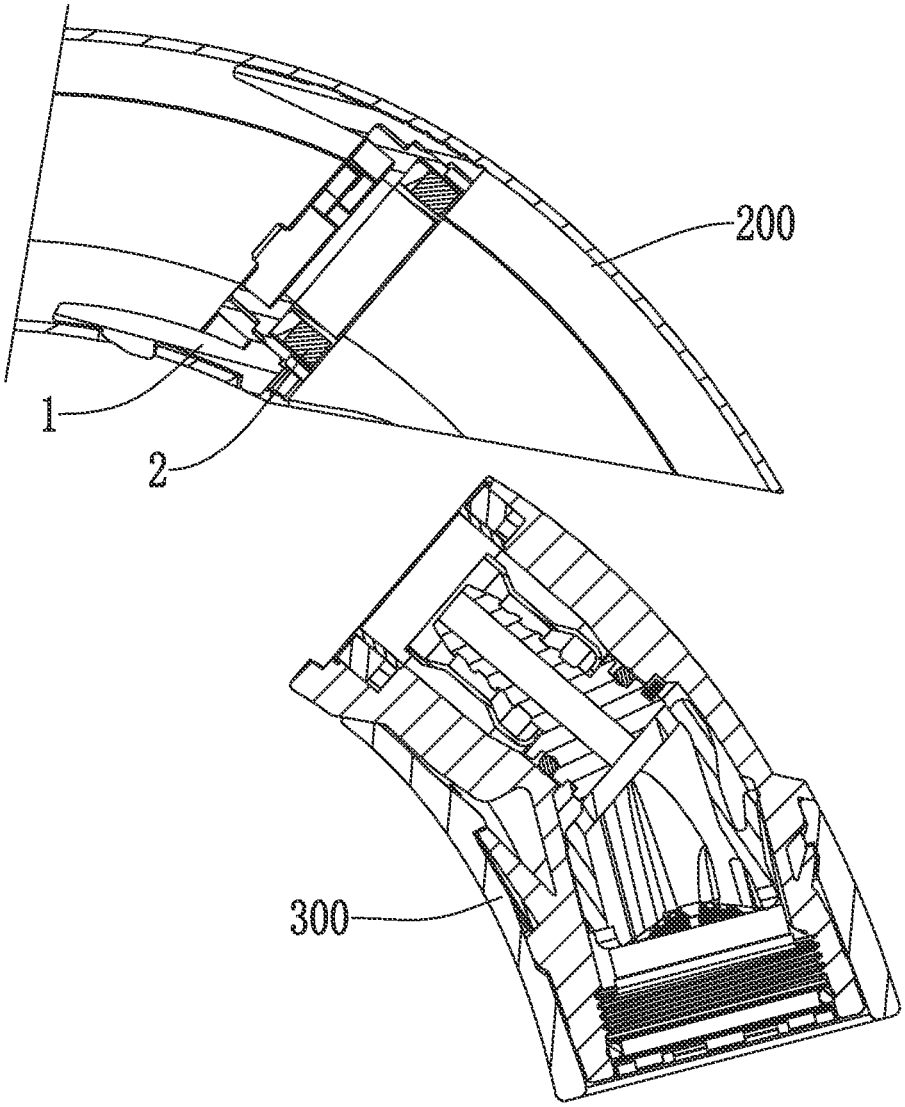
FIG. 8 illustrates a cross-sectional view of a magnetic bushing structure, a water outlet bent tube, and a pull-out head in a second embodiment of the present disclosure.
Figure 9:
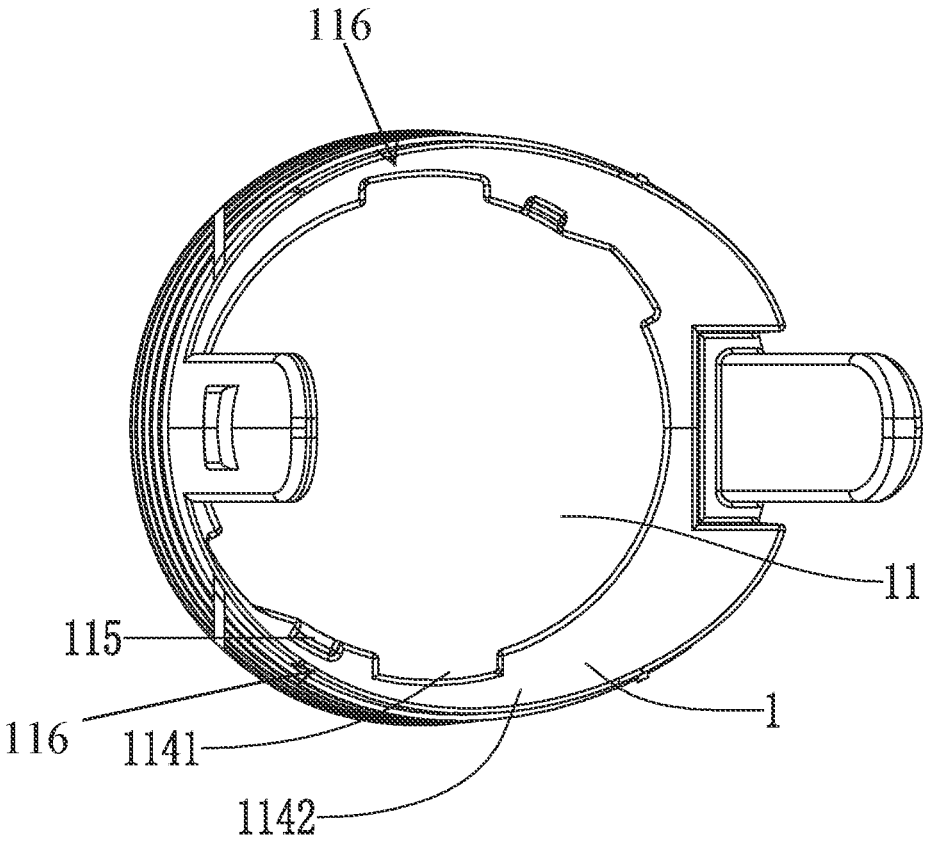
FIG. 9 illustrates a top view of a sheath in the second embodiment of the present disclosure.
Figure 10:
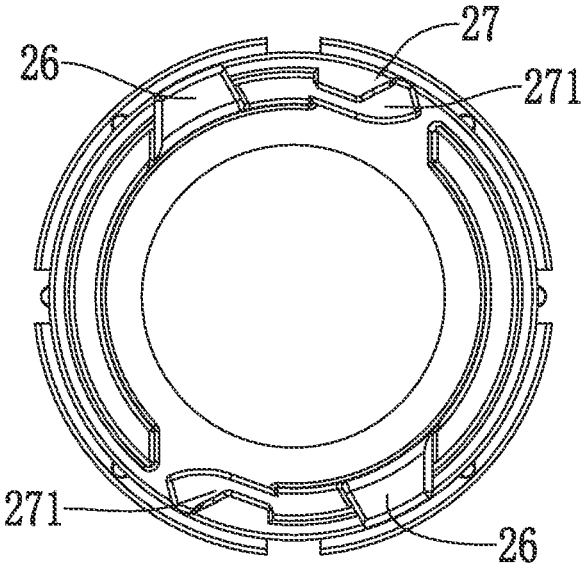
FIG. 10 illustrates a top view of a bushing in the second embodiment of the present disclosure.
Figure 11:
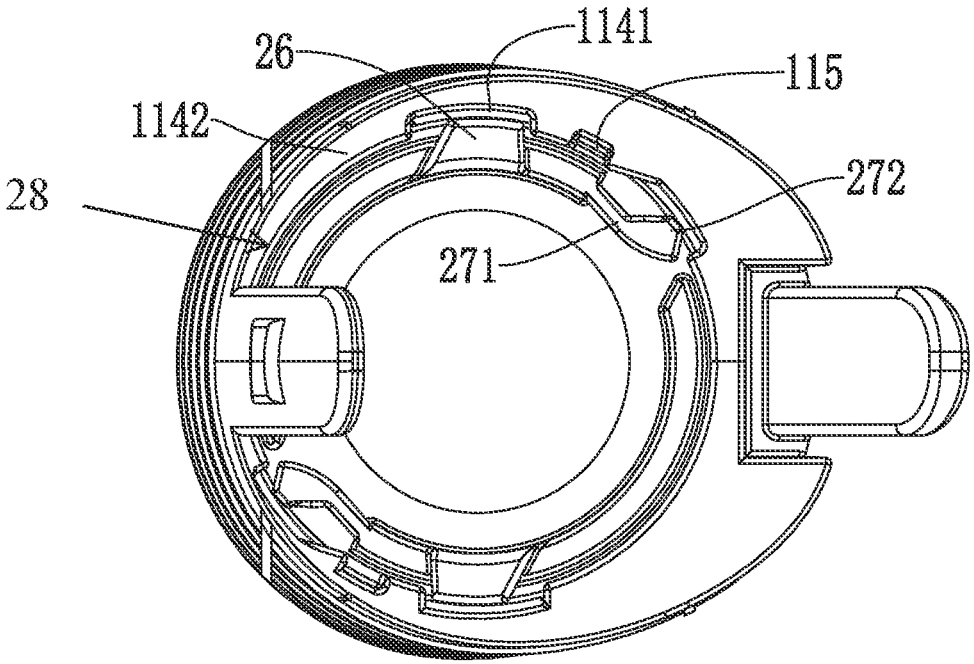
FIG. 11 illustrates a top view of the sheath and the bushing before the sheath and the bushing are connected together and the bushing is not rotated in the second embodiment of the present disclosure.
Figure 12:
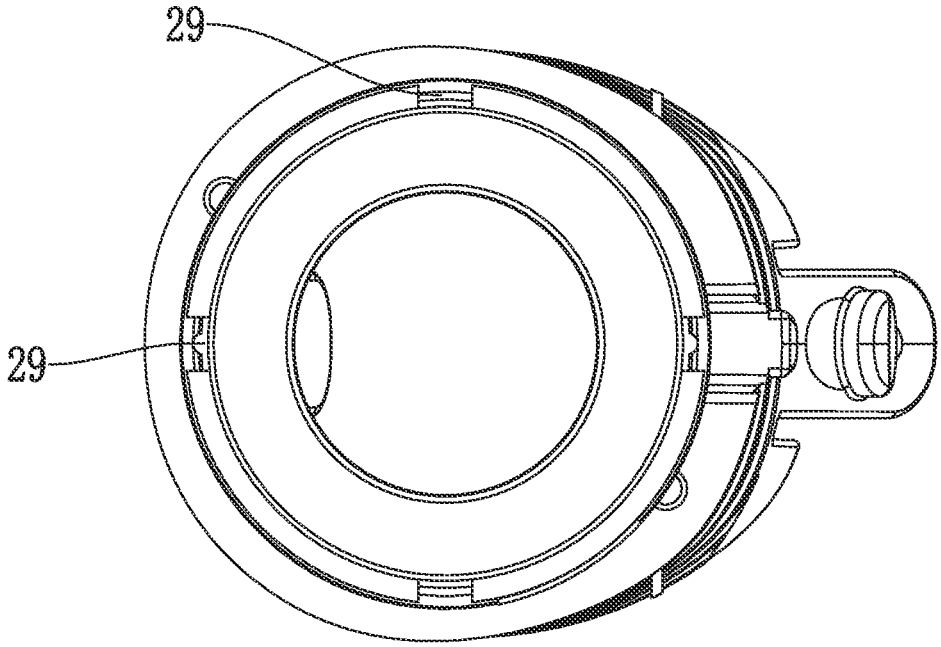
FIG. 12 illustrates a bottom view of the sheath and the bushing when the sheath and bushing are connected together in the second embodiment of the present disclosure.
Figure 13:
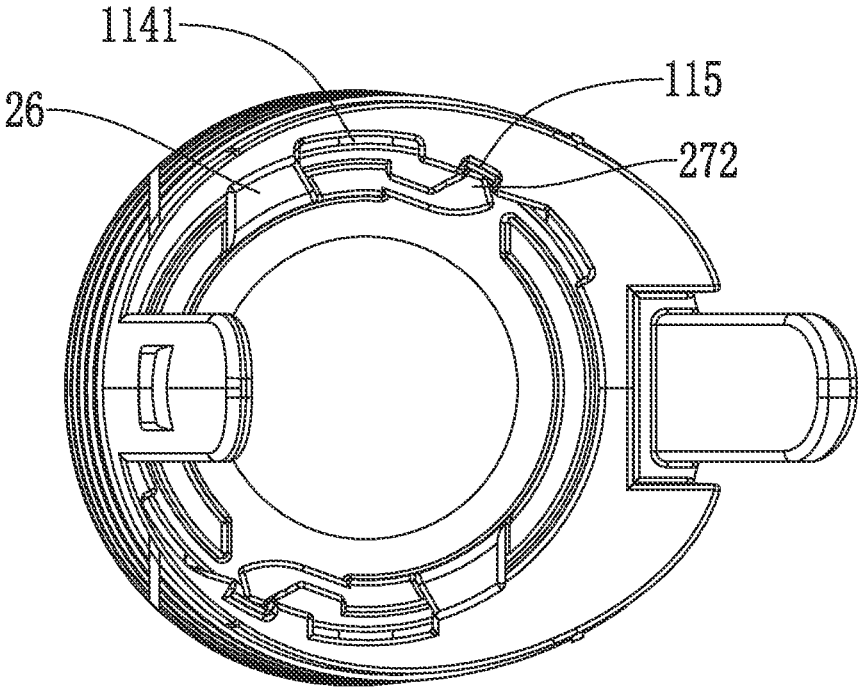
FIG. 13 illustrates a top view of the sheath and the bushing when the sheath and bushing are connected together and the bushing has been rotated in the second embodiment of the present disclosure.

Referring to FIGS. 1 to 13, a magnet bushing structure for a pull-out faucet comprises a sheath 1 and a bushing 2. The sheath 1 is configured for being fixedly connected to a water outlet bent tube 200 of the pull-out faucet. The sheath 1 comprises an installation channel 11, and the bushing 2 is at least disposed with a magnetic member 21. The bushing 2 is configured to magnetically absorb a pull-out head 300 of the pull-out faucet. The bushing 2 is detachably installed on the installation channel 11 through a buckle structure.

The magnetic bushing structure is detachably divided into the sheath 1 and the bushing 2. The sheath 1 is fixedly connected to the water outlet bent tube 200. The bushing 2 is detachably installed on the installation channel 11 of the sheath 1 through the buckle structure. The sheath 1 actually increases a wall thickness of the water outlet bent tube 200 without increasing an overall wall thickness of the water outlet bent tube 200. The bushing 2 is correspondingly disposed with the magnetic member 21, which may be a permanent magnet or the like. The bushing 2 can be disassembled and detached from the sheath 1, which is convenient for user operation.

An outer wall of the sheath 1 is at least glued to the water outlet bent tube 200 of the pull-out faucet. The outer wall of the sheath 1 further comprises a plurality of annular protrusions 12 arranged at intervals along an axial direction of the sheath 1, and the plurality of annular protrusions 12 can play an anti-slip role. In addition, adjacent annular protrusions 12 of the plurality of annular protrusions 12 can also serve to accommodate glue to prevent the glue from flowing out before solidifying during bonding. The sheath 1 further comprises one or more buckle positioning members 13, which are positioned at and connected to one or more positioning holes 210 of the water outlet bent tube 200. In some embodiments, the one or more buckle positioning members 13 are two buckle positioning members 13, and the two buckle positioning members 13 are arranged at intervals of 180 degrees along a circumferential direction of the sheath 1.

The buckle structure connecting the bushing 2 and the sheath 1 is divided into the following two embodiments.

Referring to FIGS. 1-7, a first embodiment is provided. The bushing 2 comprises a first claw 221 and a plurality of second claws 222. A first end of the first claw 221 is connected to an upper end surface of the bushing 2, and a second end of the first claw 221 comprises a hooking portion 2211. The plurality of second claws 222 are disposed on an outer wall of the bushing 2. An upper end surface of the sheath 1 comprises a hooking groove 14, and an inner wall of the installation channel 11 comprises a plurality of buckle holes 15 corresponding to the plurality of second claws 222. The first claw 221 is configured to pass through the installation channel 11 so that the hooking portion 2211 is hooked on the hooking groove 14, and the bushing 2 is rotated about the hooking groove 14 until the plurality of second claws 222 are buckled to the plurality of buckle holes 15. The installation channel 11 comprises an interference section 111, and a diameter of the interference section 111 is larger than an outer diameter of the bushing 2. The plurality of second claws 222 are elastic claws, and the plurality of second claws 222 can elastically deform when the plurality of second claws 222 pass through the interference section 111. The interference section 111 is configured for being sleeved on the outer wall of the bushing 2. A lower end of the installation channel 11 further comprises a first annular guiding surface 112, and a lower end of the outer wall of the bushing 2 further comprises a second annular guiding surface 23 that is configured to be matched with the first annular guiding surface 112. The outer wall of the bushing 2 further comprises a plurality of anti-rotation ribs 24 extending along an axial direction of the bushing 2, and the installation channel 11 comprises a plurality of anti-rotation grooves 113 into which the plurality of anti-rotation ribs 24 are inserted. The outer wall of the bushing 2 further comprises a guiding protrusion 25 corresponding to a position which is lower than the hooking portion 2211. A lower end surface of the sheath 1 further comprises a guiding groove 16. The guiding protrusion 25 is inserted into the guiding groove 16.

In this embodiment, the hooking portion 2211 of the first claw 221 is arc-shaped, and the hooking groove 14 is U-shaped.

In the first embodiment, the sheath 1 is first put on and is glued to the water outlet bent tube 200, and then the bushing 2 is installed on the sheath 1. The bushing 2 is installed from a bottom of the sheath 1 upward. The hooking portion 2211 of the first claw 221 of the bushing 2 is first disposed on the hooking groove 14 of the sheath 1, which is U-shaped. Through the guiding protrusion 25 being inserted into the guiding groove 16, an appropriate position of the bushing 2 is confirmed. In some embodiments, the plurality of second claws 222 are two second claws 222 located a side of the bushing 2 away from the guiding protrusion 25, and the two second claws 222 are forced to pass through the interference section 111 of the sheath 1. Through the first annular guiding surface 112 and the second annular guiding surface 23, the bushing 2 and the sheath 1 are coaxially positioned relative to each other. In the first embodiment, the two second claws 222 is made of plastic, and by utilizing elasticity of plastic, the two second claws 222 of the bushing 2 will restore to their original shape after passing through the interference section 111. Finally, the two second claws 222 are buckled to the plurality of buckle holes 15 of the sheath 1, and the bushing 2 is flush with a bottom end surface of the sheath 1.

In this embodiment, a diameter of an outermost end of the two second claws 222 of the bushing 2 relative to a center of the bushing 2 is 24.27 mm, and a diameter of the interference section 111 of the sheath 1 is 23.86 mm. A buckling length of the two second claws 222 buckled to the sheath 1 is 0.41 mm, and each side of the two second claws 222 buckled to the sheath 1 is 0.205 mm. If the buckling length of the two second claws 222 is increased, the elasticity of the plastic will be too great to pass through the interference section 111. If the buckling length of the two second claws 222 is reduced, the two second claws 222 can pass through the interference section 111, but a downward pulling force acting on the two second claws 222 may make the two second claws 222 leave the sheath 1. In the comparison of multiple groups of samples, the buckling length of 0.41 mm best meets the requirements. Tensile strength is best suited for ease of use in assembly. A diameter of an outermost end of an upper part of the plurality of anti-rotation ribs 24 relative to the center of the bushing 2 is 23.86 mm. A diameter of an outermost end of a lower part of the plurality of anti-rotation ribs 24 relative to the center of the bushing 2 is 24.11 mm. A diameter of an outermost end of an upper part of the plurality of anti-rotation grooves 113 relative to a center of the sheath 1 is 23.66 mm, and a diameter of an outermost end of a lower part of the plurality of anti-rotation grooves 113 relative to the center of the sheath 1 is 23.86 mm. An upper rib interference amount is 0.1 mm on each side, and a lower rib interference amount is 0.125 mm on each side, which has a best anti-rotation effect.

Referring to FIGS. 8-13, a second embodiment is provided. An upper end of the bushing 2 comprises a plurality of third claws 26 and at least one anti-rotation mechanism 27. An upper side of the installation channel 11 comprises a plurality of rotation buckle positions 116, and the upper side of the installation channel 11 further comprises at least one anti-rotation recess 115. The bushing 2 is configured to be axially installed from the lower end of the installation channel 11 to a first installation position. The bushing 2 can be operatively rotated from the first installation position to a second installation position, and in the second installation position, the plurality of third claws 26 are connected to the plurality of rotation buckle positions 116 to inhibit axial movement of the bushing 2, and the at least one anti-rotation mechanism 27 is connected to the at least one anti-rotation recess 115 to inhibit circumferential movement of the bushing 2. Each of the plurality of rotation buckle positions 116 comprises a first through groove 1141 arranged on the installation channel 11 along an axial direction of the installation channel 11. Each of the plurality of rotation buckle positions 116 further comprises a buckle surface 1142. The buckle surface 1142 extends along a circumferential direction of the installation channel 11. The plurality of third claws 26 move in the first through groove 1141 in the axial direction of the installation channel 11 to correspond to the buckle surface 1142 at the first installation position, and the plurality of third claws 26 are rotated in the circumferential direction of the installation channel 11 to be at the second installation position to be correspondingly buckled to the buckle surface 1142. The at least one anti-rotation mechanism 27 comprises an elastic cantilever 271, and the elastic cantilever 271 and the at least one anti-rotation recess 115 define a ratchet-and-pawl type of anti-rotation mechanism. A first end of the elastic cantilever 271 is fixedly connected to the bushing 2, and a second end of the elastic cantilever 271 extends in an inverse direction relative to a rotation direction of the bushing 2. A blocking block 272 is disposed on an outside of the elastic cantilever 271. The elastic cantilever 271 can be elastically deformed by an external force to enable the blocking block 272 to move radially inward. When the bushing 2 rotates, the blocking block 272 of the elastic cantilever 271 moves radially inward so that the blocking block 272 is inserted into the at least one anti-rotation recess 115. After the blocking block 272 is inserted into the at least one anti-rotation recess 115, when the bushing 2 is rotated in an opposite direction, movement of the blocking block 272 will be correspondingly inhibited by the at least one anti-rotation recess 115 since the blocking block 272 receives greater resistance. The outer wall of the bushing 2 comprises a plurality of anti-loosening ribs 28, and the anti-loosening ribs 28 are in contact with the inner wall of the installation channel 11. A lower end of the bushing 2 comprises one or more wrench grooves 29. The wrench grooves 29 are used to be connected to tools so that the tools can drive the bushing 2 to rotate.

In the second embodiment, the bushing 2 is installed upward from the bottom of the sheath 1. The bushing 2 should first be aligned with an initial installation indication direction, and there should be no jamming during the installation of the sheath 1. The two third claws 26 (i.e., the plurality of third claws 26) and the two anti-rotation mechanisms 27 (i.e., the at least one anti-rotation mechanism 27) of the bushing 2 both pass through the sheath 1 until the bushing 2 is flush with the bottom end surface of the sheath 1. A wrench is used to rotate the bushing 2 so that the two third claws 26 of the bushing 2 are on a top plane of the sheath 1 (that is, the buckle surface 1142). After the bushing 2 is rotated to a certain angle with the wrench, the two anti-rotation mechanisms 27 of the bushing 2 and the two anti-rotation recesses 115 (i.e., the at least one anti-rotation recess 115) of the sheath 1 will be buckled to each other, and there will be a certain resistance when they rotate out.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A magnet bushing structure for a pull-out faucet, comprising:

a sheath, and a bushing, wherein:

the sheath is configured for being fixedly connected to a water outlet bent tube of the pull-out faucet, the sheath comprises an installation channel, the bushing is at least disposed with a magnetic member to enable the bushing to magnetically absorb a pull-out head of the pull-out faucet, the bushing is detachably installed on the installation channel through a buckle structure, an upper end of the bushing comprises a plurality of third claws and at least one anti-rotation mechanism, an upper side of the installation channel comprises a plurality of rotation buckle positions, the upper side of the installation channel comprises at least one anti-rotation recess, the bushing is configured to be axially installed from a lower end of the installation channel to a first installation position, the bushing is configured to be operatively rotated from the first installation position to a second installation position, when at the second installation position:

the plurality of third claws are connected to the plurality of rotation buckle positions to inhibit axial movement of the bushing, and the at least one anti-rotation mechanism is connected to the at least one anti-rotation recess to inhibit circumferential movement of the bushing.

2. The magnet bushing structure for the pull-out faucet according to claim 1, wherein:

an outer wall of the sheath is at least glued to the water outlet bent tube of the pull-out faucet, and the sheath further comprises one or more buckle positioning members which are positioned at and connected to one or more positioning holes of the water outlet bent tube.

3. The magnet bushing structure for the pull-out faucet according to claim 1, wherein:

the bushing comprises a first claw and a plurality of second claws, a first end of the first claw is connected to an upper end surface of the bushing, a second end of the first claw comprises a hooking portion, the plurality of second claws are disposed on an outer wall of the bushing, an upper end surface of the sheath comprises a hooking groove, an inner wall of the installation channel comprises a plurality of buckle holes configured to correspond to the plurality of second claws, the first claw is configured to pass through the installation channel so that the hooking portion is hooked on the hooking groove, and the bushing is configured to be rotated about the hooking groove until the plurality of second claws are buckled to the plurality of buckle holes.

4. The magnet bushing structure for the pull-out faucet according to claim 3, wherein:

the installation channel comprises an interference section, a diameter of the interference section is larger than an outer diameter of the outer wall of the bushing, the plurality of second claws are elastic claws, the plurality of second claws are configured to elastically deform when the plurality of second claws pass through the interference section, and the interference section is configured for being sleeved on the outer wall of the bushing.

5. The magnet bushing structure for the pull-out faucet according to claim 3, wherein:

the lower end of the installation channel comprises a first annular guiding surface, and a lower end of the outer wall of the bushing comprises a second annular guiding surface that is configured to be matched with the first annular guiding surface.

6. The magnet bushing structure for the pull-out faucet according to claim 1, wherein:

the outer wall of the bushing comprises a plurality of anti-rotation ribs extending along an axial direction of the bushing, and the installation channel comprises a plurality of anti-rotation grooves in which the plurality of anti-rotation ribs are disposed.

7. The magnet bushing structure for the pull-out faucet according to claim 1, wherein:

each of the plurality of rotation buckle positions comprises a first through groove arranged on the installation channel along an axial direction of the installation channel, each of the plurality of rotation buckle positions comprises a buckle surface, the buckle surface extends along a circumferential direction of the installation channel, the plurality of third claws are configured to move in the first through groove in the axial direction of the installation channel to correspond to the buckle surface at the first installation position, the plurality of third claws are configured to be rotated in the circumferential direction of the installation channel to be at the second installation position to be correspondingly buckled to the buckle surface, the at least one anti-rotation mechanism comprises an elastic cantilever, and the elastic cantilever and the at least one anti-rotation recess define a ratchet-and-pawl type of anti-rotation mechanism.

8. The magnet bushing structure for the pull-out faucet according to claim 1, wherein:

an outer wall of the bushing comprises a plurality of anti-loosening ribs, the plurality of anti-loosening ribs are in contact with an inner wall of the installation channel, a lower end of the bushing comprises one or more wrench grooves, and the one or more wrench grooves are configured to be connected to tools so that the tools are configured to drive the bushing to rotate.

9. The magnet bushing structure for the pull-out faucet according to claim 2, wherein:

the bushing comprises a first claw and a plurality of second claws, a first end of the first claw is connected to an upper end surface of the bushing, a second end of the first claw comprises a hooking portion, the plurality of second claws are disposed on an outer wall of the bushing, an upper end surface of the sheath comprises a hooking groove, an inner wall of the installation channel comprises a plurality of buckle holes configured to correspond to the plurality of second claws, the first claw is configured to pass through the installation channel so that the hooking portion is hooked on the hooking groove, and the bushing is configured to be rotated about the hooking groove until the plurality of second claws are buckled to the plurality of buckle holes.

10. The magnet bushing structure for the pull-out faucet according to claim 9, wherein:

the installation channel comprises an interference section, a diameter of the interference section is larger than an outer diameter of the outer wall of the bushing, the plurality of second claws are elastic claws, the plurality of second claws are configured to elastically deform when the plurality of second claws pass through the interference section, and the interference section is configured for being sleeved on the outer wall of the bushing.

11. The magnet bushing structure for the pull-out faucet according to claim 10, wherein:

the lower end of the installation channel comprises a first annular guiding surface, and a lower end of the outer wall of the bushing comprises a second annular guiding surface that is configured to be matched with the first annular guiding surface.

12. The magnet bushing structure for the pull-out faucet according to claim 10, wherein:

the outer wall of the bushing comprises a plurality of anti-rotation ribs extending along an axial direction of the bushing, and the installation channel comprises a plurality of anti-rotation grooves in which the plurality of anti-rotation ribs are disposed.

13. The magnet bushing structure for the pull-out faucet according to claim 2, wherein:

each of the plurality of rotation buckle positions comprises a first through groove arranged on the installation channel along an axial direction of the installation channel, each of the plurality of rotation buckle positions comprises a buckle surface, the buckle surface extends along a circumferential direction of the installation channel, the plurality of third claws are configured to move in the first through groove in the axial direction of the installation channel to correspond to the buckle surface at the first installation position, the plurality of third claws are configured to be rotated in the circumferential direction of the installation channel to be at the second installation position to be correspondingly buckled to the buckle surface, the at least one anti-rotation mechanism comprises an elastic cantilever, and the elastic cantilever and the at least one anti-rotation recess define a ratchet-and-pawl type of anti-rotation mechanism.

14. The magnet bushing structure for the pull-out faucet according to claim 2, wherein:

an outer wall of the bushing comprises a plurality of anti-loosening ribs, the plurality of anti-loosening ribs are in contact with an inner wall of the installation channel, a lower end of the bushing comprises one or more wrench grooves, and the one or more wrench grooves are configured to be connected to tools so that the tools are configured to drive the bushing to rotate.

15. The pull-out faucet, comprising the magnet bushing structure according to claim 1.

16. A magnet bushing structure for a pull-out faucet, comprising:

a sheath, and a bushing, wherein:

the sheath is configured for being fixedly connected to a water outlet bent tube of the pull-out faucet, the sheath comprises an installation channel, the bushing is at least disposed with a magnetic member to enable the bushing to magnetically absorb a pull-out head of the pull-out faucet, the bushing is detachably installed on the installation channel through a buckle structure, an outer wall of the sheath is at least glued to the water outlet bent tube of the pull-out faucet, and the sheath further comprises one or more buckle positioning members which are positioned at and connected to one or more positioning holes of the water outlet bent tube.

17. A magnet bushing structure for a pull-out faucet, comprising:

a sheath, and a bushing, wherein:

the sheath is configured for being fixedly connected to a water outlet bent tube of the pull-out faucet, the sheath comprises an installation channel, the bushing is at least disposed with a magnetic member to enable the bushing to magnetically absorb a pull-out head of the pull-out faucet, the bushing is detachably installed on the installation channel through a buckle structure, the bushing comprises a first claw and a plurality of second claws, a first end of the first claw is connected to an upper end surface of the bushing, a second end of the first claw comprises a hooking portion, the plurality of second claws are disposed on an outer wall of the bushing, an upper end surface of the sheath comprises a hooking groove, an inner wall of the installation channel comprises a plurality of buckle holes configured to correspond to the plurality of second claws, the first claw is configured to pass through the installation channel so that the hooking portion is hooked on the hooking groove, and the bushing is configured to be rotated about the hooking groove until the plurality of second claws are buckled to the plurality of buckle holes.

* * * * *